US005868554A

United States Patent [19]

Giacomino et al.

[11] Patent Number: 5,868,554

[45] Date of Patent: Feb. 9, 1999

[54] FLEXIBLE PLUNGER APPARATUS FOR FREE MOVEMENT IN GAS-PRODUCING WELLS

[76] Inventors: Jeff L. Giacomino; Bruce M. Victor, both of 1762 Denver Ave., Fort Lupton, Colo. 80621

[21] Appl. No.: 736,033

[22] Filed: Oct. 23, 1996

Related U.S. Application Data

[60] Provisional application No. 60/005,881 Oct. 26, 1995.

[51] Int. Cl. [6] ..... F04B 47/12

[52] U.S. Cl. ..... 417/56; 92/255; 92/256; 92/137; 403/300; 403/314

[58] Field of Search ..... 417/56; 92/255, 92/256, 137; 403/300, 314

[56] References Cited

U.S. PATENT DOCUMENTS

| | | | |
|---|---|---|---|
| 47,031 | 3/1865 | Moore | 279/101 |
| 329,162 | 10/1885 | Hamilton | 403/314 |
| 892,093 | 6/1908 | Sillett | 166/68 |
| 940,347 | 11/1909 | McCarthy et al. | 417/554 |
| 1,056,347 | 3/1913 | Mack | 417/320 |
| 1,495,807 | 5/1924 | Sanders | 417/552 |
| 1,620,934 | 3/1927 | Zinn | 417/401 |
| 1,721,245 | 7/1929 | Black | 417/456 |
| 2,056,248 | 10/1936 | Buchanan | 173/303 |
| 2,147,766 | 2/1939 | Coberly | 103/46 |
| 2,659,062 | 10/1953 | Tibbetts | 339/211 |
| 2,704,980 | 3/1955 | Vincent | 417/59 |
| 2,714,855 | 8/1955 | Brown | 103/52 |
| 3,181,470 | 5/1965 | Clingman | 103/52 |
| 3,203,351 | 8/1965 | Gillis | 417/57 |
| 3,319,572 | 5/1967 | Lyles | 417/59 |
| 3,412,798 | 11/1968 | Gregston | 417/56 |
| 3,724,076 | 4/1973 | Schmitz | 32/60 |
| 4,048,365 | 9/1977 | Sparks, Sr. | 417/554 |
| 4,410,300 | 10/1983 | Yerian | 417/56 |
| 4,467,705 | 8/1984 | Reist | 92/137 |
| 4,502,843 | 3/1985 | Martin | 417/56 |
| 4,813,485 | 3/1989 | Coyle | 166/372 |
| 4,856,414 | 8/1989 | Churkin et al. | 92/83 |
| 4,872,509 | 10/1989 | Dickinson et al. | 166/278 |
| 4,889,473 | 12/1989 | Krueger | 417/56 |
| 5,594,977 | 1/1997 | McCallion | 24/136 B |

OTHER PUBLICATIONS

Multi Products Co. Rigid Plungers—2 Sheets.
Well Master Corporation Rigid Plungers—2 Sheets.
Production Control Serviced Rigid Plungers and Bumper Springs—6 Sheets.
Ferguson Beauregard Inc Rigid Plungers—2 Sheets.

*Primary Examiner*—Timothy Thorpe
*Assistant Examiner*—Ehud Gartenberg
*Attorney, Agent, or Firm*—John R. Flanagan; John K. Flanagan; Flanagan & Flanagan

[57] ABSTRACT

A flexible plunger apparatus includes an elongated flexible member having a pair of opposite end portions and a longitudinal length extending between the opposite end portions, with the flexible member being adapted to flex in transverse relationship to its length and to undergo free movement through a hollow tubing of a well. The apparatus also includes a physical barrier producing mechanism attached to and extending between the opposite end portions of the flexible member for substantially separating gas under pressure in the tubing below the lower end portion of the flexible member from a slug of liquid in the tubing above the upper end portion of the flexible member. The physically barrier producing mechanism is carried along the interior surface of the tubing in a substantially sealing relationship therewith as the flexible member undergoes free movement through the tubing of the well in response to the pressure of the gas and opening of the tubing of the well at the earth surface. The transverse flexibility of the flexible member adapts the apparatus to move through hollow tubing which has an angular, helical or wavy curvature.

12 Claims, 3 Drawing Sheets

FLEXIBLE PLUNGER APPARATUS FOR FREE MOVEMENT IN GAS-PRODUCING WELLS

This application claims the benefit of U.S. provisional application Ser. No. 60/005,881, filed Oct. 26, 1995.

BACKGROUND OF THE INVENTION

1. Field of the Invention

The present invention generally relates to plungers for use in gas-producing wells and, more particularly, is concerned with a flexible plunger apparatus designed for free movement in these wells.

2. Description of the Prior Art

Gas-producing wells typically employ a plunger disposed within a tubing of a well and capable of traveling vertically in the tubing as the well is cycled between shut-in and opened conditions in a manner wellknown to one of ordinary skill in the art. The plunger has been referred to as a "floating" or "free" plunger in U.S. Pat. No. 2,714,855 to Brown and as a "gas lift" plunger in U.S. Pat. No. 3,181,470 to Clingman in view that the plunger is freely movable vertically in the well tubing and is adapted to rise vertically under the force of sufficient gas pressure to drive or lift the plunger and a slug of liquid, such as oil, above it to the surface while isolating the base of the liquid slug from the gas which lifts the plunger. The plunger falls by gravity back down the tubing of the well after the slug of liquid has been delivered to the surface.

As shown in FIGS. 1 and 2, a typical prior art plunger P is a rigid inflexible device. The rigid plunger P has a rigid, non-flexible central rod R and a pair of end members E attached to opposite upper and lower ends of the rod R. Between the opposite ends of the rod R, the plunger P typically has a series of segments S, such as wobbly washers (see FIGS. 5 and 6), a brush (see FIGS. 9 and 10), expandable pads (see FIG. 11) or the like, applied over the rod R for creating with the interior surface of the tubing T a physical barrier or sliding seal to isolate the gas from the liquid slug and also for wiping parafin and the like from the inside wall of the tubing T. Gas pressure in the tubing T below the plunger P increases during well shut-in condition so as to cause lifting of the plunger P to the upper end of the tubing T when the well is opened. When the well is then returned to the shut-in condition, the plunger P due to the force of gravity falls to the lower end of the tubing T until the pressure of the gas has built up again. The purpose of the plunger P is generally two-fold: primarily, the plunger provides a physical barrier or moving seal between gas below and the slug of liquid above the plunger P for removal of the liquid slug which is forced from the tubing T when the well is opened; secondarily, the plunger wipes the interior surface of the tubing T in order to prevent build-up of parafin or the like thereon.

A growing number of gas-producing wells, however, use coiled flexible tubing. This tubing when uncoiled and inserted into the well bore tends to take on a helical or wavy curvature. There are other applications where portions of the well casing or tubing take on an angular condition. Prior art rigid plungers, being generally inflexible longitudinally or lengthwise, tend not to be able to negotiate the curvature of the tubing. Thus, a rigid plunger may bind up and become stalled, requiring the initiation of a time-consuming and costly fishing-out operation to be performed from the surface to remove the plunger.

Consequently, a need still exists for an apparatus which overcomes the aforementioned problem with prior art rigid plungers in gas-producing wells without introducing any new problems in place thereof.

SUMMARY OF THE INVENTION

The present invention provides a flexible plunger apparatus designed to satisfy the aforementioned need. The apparatus of the present invention is for use in gas-producing wells to remove liquid which accumulates above the apparatus and to remove paraffin which accumulates on the inside surface of the hollow tubing used in the wells. The apparatus is adapted to flex in transverse relationship to its length and to undergo free movement through the well tubing. The apparatus is further especially adapted for movement through tubing which has a helical or wavy curvature or otherwise has an angular condition.

Accordingly, the present invention is directed to a flexible plunger apparatus for free movement in a gas-producing well below earth surface. The flexible plunger apparatus comprises: (a) an elongated flexible member having a pair of opposite upper and lower end portions and a longitudinal length extending between the opposite end portions, with the flexible member being adapted to flex in transverse relationship to its length and to undergo free movement through a hollow tubing in a well; and (b) means disposed about the elongated flexible member and along the length and between the opposite end portions thereof for producing a physical barrier substantially separating gas under pressure in the tubing below the lower end portion of the flexible member from a slug of liquid in the tubing above the upper end portion of the flexible member such that the physically barrier producing means is carried by the flexible member along the interior surface of the tubing in a substantially sealing relationship therewith as the flexible member undergoes free movement through the tubing of the well in response to the pressure of the gas and opening of the tubing of the well at earth surface.

More particularly, the elongated flexible member is a substantially straight flexible cable. The cable is preferably, although not necessarily, a multi-stranded and spirally-wound cable with each strand being individually wound. The flexible cable extends axially through the center and along the length of the apparatus and has transverse flexibility.

The physical barrier producing means includes a pair of retainer elements each attached about one of the upper and lower end portions of the flexible member and one or more seal elements disposed about the flexible member and extending between the retainer elements. The retainer elements include annular ferrules deformed so as to stationarily and fixedly grip the respective opposite end portions of the flexible member.

Also, the seal elements of the physical barrier producing means have exterior surfaces disposed adjacent to the interior surface of the tubing so as to wipe the interior surface of the tubing of the well as the flexible member undergoes free movement through the tubing so as to prevent paraffin build-up on the interior surface of the tubing. The seal elements are mounted over and along the longitudinal length of the flexible member between the retainer elements attached on the opposite end portions of the flexible member.

Furthermore, the flexible plunger apparatus comprises a spring-loaded assembly attached to one of the opposite end portions of the flexible member and preferably adapted to expand and retain the seal elements on the flexible member along the length thereof in a relatively close fitting side-by-side relationship when the flexible member is in a relatively straight unflexed state. The spring-loaded assembly is also adapted to contract and allow the seal elements to move axially away from one another in response to flexing of the flexible member. More particularly, the spring-loaded assembly includes a biasing spring extending around and along the flexible member and an inner cap axially movably mounted on the flexible member and having a threaded end.

The flexible plunger apparatus further comprises a hollow fishneck element that slidably fits over and covers the coil spring and the one opposite end portion of the flexible member. The fishneck element is threadably coupled to the threaded end of the inner cap and thereby can axially move with the inner cap relative to the flexible member so as to permit the seal elements to move axially in response to flexing of the flexible member. The fishneck element also surrounds the annular ferrule attached to the one opposite end portion.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 12:
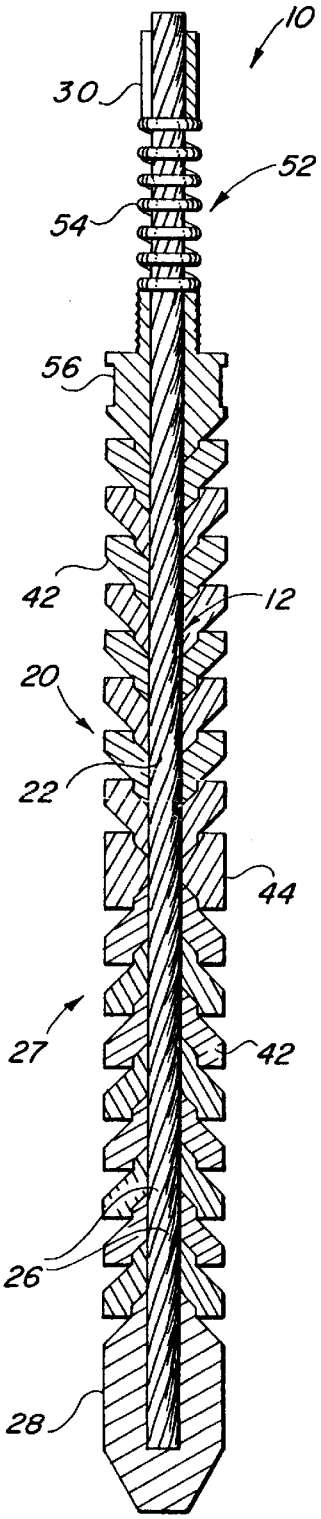
FIG. 12 is an axial sectional view, on a reduced scale compared to FIGS. 7 and 8, of a second embodiment of the flexible plunger apparatus of the present invention.

Referring to the drawings and particularly to FIGS. 3, 4, 7 and 8, there is illustrated a first embodiment of a flexible plunger apparatus, generally designated 10, of the present invention. In FIG. 12, a second embodiment of the flexible plunger apparatus 10 is shown, which is only slightly different from the first embodiment thereof. The flexible plunger apparatus 10 is adapted for undergoing free movement in the hollow tubing T of a gas-producing well below the earth surface to, primarily, lift a slug of liquid accumulated above the apparatus 10 in the tubing T to the earth surface and, secondarily, wipe and remove paraffin and the like which accumulates on an interior surface I of hollow tubing T.

Basically, referring to FIGS. 4, 7, 8 and 12, the flexible plunger apparatus 10 includes an elongated flexible member 12 having a pair of upper and lower opposite end portions 14, 16 and a longitudinal length 18 extending between the opposite end portions 14, 16, and a physical barrier producing mechanism 20 disposed about the flexible member 12 and along the length 18 thereof and between the opposite end portions 14, 16 thereof. The flexible member 12 is adapted to undergo free movement through the hollow tubing T and to flex in transverse relationship to its length 18 so as to facilitate travel of the flexible plunger apparatus 10 through variously curved sections of the tubing T as it undergoes free movement through the length of the tubing. Thus, the flexible member 12 is especially adapted for movement through tubing T which has a helical or wavy curvature or has an otherwise angular condition, as seen in FIG. 3.

The elongated flexible member 12 of the apparatus 10 preferably, although not necessary, is provided in the form of a flexible cable 22, although other constructions and configurations of the flexible member 12 can be provided. The flexible cable 22 preferably is multi-stranded and spirally-wound with each strand 24 being individually wound. The flexible cable 22 extends axially through the center and along the length of the apparatus 10 and has transverse flexibility.

Figure 3:
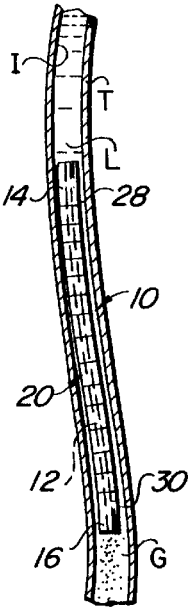
FIG. 3 is a fragmentary side elevational view of a longitudinally-sectioned well tubing within which is employed the flexible plunger apparatus of the present invention.

As seen in FIG. 3, the physical barrier producing mechanism 20 of the apparatus 10, which extends radially outwardly from the flexible member 12 close to the interior surface I of the tubing T, substantially separates the gas G under pressure in the tubing T below the lower end portion 16 of the flexible member 12 from a slug of liquid L in the tubing T above the upper end portion 14 of the flexible member 12. The physical barrier producing mechanism 20 is carried by the flexible member 12 along the interior surface I of the hollow tubing T in a sealing relationship therewith as the flexible member 12 undergoes free movement through the tubing T in response to the pressure of the gas and the opening of the tubing T of the well as the surface of the earth.

More particularly, the physical barrier producing mechanism 20 includes a pair of retainer elements 26 respectively attached about the upper and lower end portions 14, 16 of the flexible member 12 and one or more seal elements 27 disposed about the flexible cable 22 and extending between the retainer elements 26. The retainer elements 26 of the physical barrier producing mechanism 20 includes annular-shaped ferrules 28, 30 deformed so as to stationarily and fixedly grip the respective opposite end portions 14, 16 of the flexible cable 22. In the second embodiment as seen in FIG. 12, which is the more preferred embodiment because of its simplicity, each of the annular ferrules 28, 30 is deformed on the flexible cable 22 by each ferrule 28, 30 being crimped thereon using a suitable tool.

Figures 7, 8:
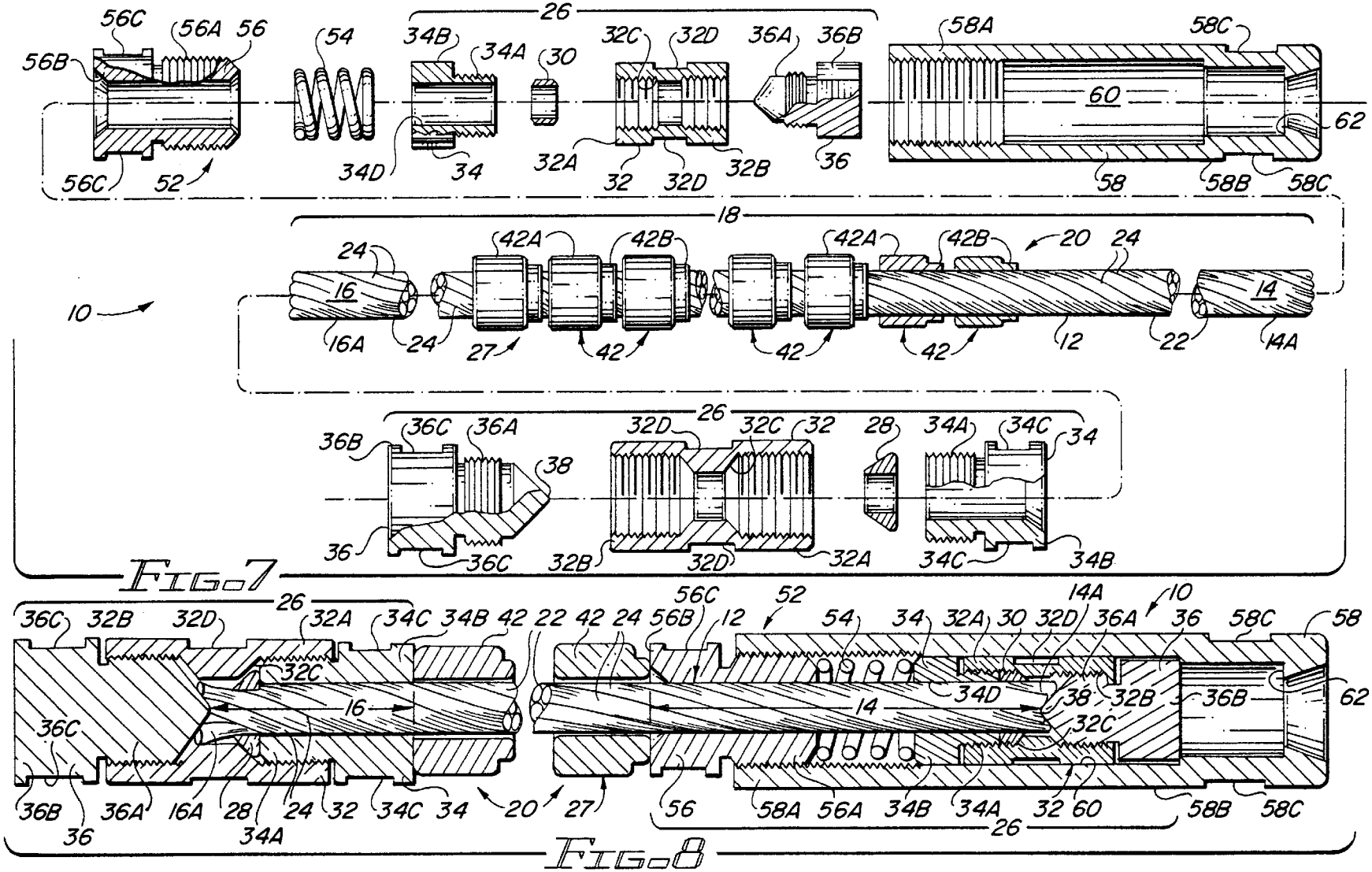
FIG. 7 is an enlarged exploded side elevational view, with portions axially sectioned and foreshortened, of the first embodiment of the flexible plunger apparatus of the present invention shown in FIG. 4.
FIG. 8 is an enlarged foreshortened axial sectional view of the flexible plunger apparatus taken along line 8—8 of FIG. 4.

In the first embodiment as seen in FIGS. 7 and 8, the clamping of the ferrules 28, 30 to the cable 22 is somewhat more complicated than in the second embodiment. In the first embodiment, in addition to the ferrules 28, 30, each of the retainer elements 26 includes a hollow threaded sleeve 32 and a pair of inner and outer threadable fittings 34, 36 which are applied and tightened together on a respective one of the opposite end portions 14, 16 of the flexible cable 22 so as to capture and clamp the respective one of the annular ferrules 28, 30 thereon. The hollow sleeve 32 is internally threaded at its opposite ends 32A, 32B and has a conical shaped annular shoulder 32C formed therein facing toward the inner one 32A of its opposite ends. The annular ferrule 28, 30 of each retainer element 26 is disposed over and in a tightly fitted relationship on the flexible member 12 between the sleeve 32 and the inner fitting 34. The sleeve 32 also has a pair of external opposite flat surfaces 32D for gripping and rotation of the sleeve 32. The inner fitting 34 has an externally threaded portion 34A and a gripping portion 34B. The gripping portion 34B has a pair of external opposite flat surfaces 34C for gripping the inner fitting 34. The inner fitting 34 also has a central bore 34D for receiving the respective one of the opposite end portions 14, 16 of the threaded member 12 therethrough. The inner fitting 34 and sleeve 32 are gripped by suitable wrenches and rotated relative to one another so that the threaded portion 34A of the inner fitting 34 screws into the inner threaded end 32A of the sleeve 32 in order to fasten the inner fitting 34 and sleeve 32 to one another and apply forces in opposite directions to the respective ferrule 28, 30 between the conical-shaped annular shoulder 32C of the sleeve 32 and end of the inner fitting 34 which compress the ferrule 28, 30 into the tight fitting relationship about the flexible member 12. The ferrule 28, 30 is thus caused to grip the respective one of the opposite end portions 14, 16 of the flexible member 12 at a respective location spaced from a respective one of the opposite outer ends 14A, 16A thereof.

In such manner, in the second embodiment the ferrules 28, 30 are secured to the respective end portions 14, 16 of the flexible member 12. Also, in the second embodiment, the outer fitting 36 likewise has an externally threaded portion 36A with a pointed end 38 and a gripping portion 36B. The gripping portion 36B has a pair of external opposite flat surfaces 36C for gripping the outer fitting 36. By gripping and rotating the outer fitting 36 relative to the sleeve 32, the threaded portion 36A of the outer fitting 36 is screwed into the outer end 32B of the sleeve 32 and the pointed end 38 is forced into the respective outer end 14A, 16A of the respective end portion 14, 16 of the flexible member 12 to cause the respective outer end 14A, 16A thereof to expand within the hollow sleeve 32 and thereby provide additional securement of the respective ferrules 28, 30 to the respective end portions 14, 16 of the flexible member 12. The above-described components are made of a suitable substantially rigid material and are substantially cylindrical in shape.

The seal elements 27 are mounted over and along the longitudinal length 18 of the flexible member 12 between the retainer elements 26 attached on the opposite end portions 14, 16 of the flexible member 12. The exterior surfaces 27A of the seal elements 27 are disposed close to the interior surface I of the tubing T and thus are provided in a substantially sealing relationship therewith which maintains the separation of the gas G under pressure in the tubing T below the lower end portion 16 of the flexible member 12 from the slug of liquid L in the tubing T above the upper end portion 14 of the flexible member 12. Also, in this sealing relationship with the interior surface I of the tubing T, the annular seal elements 27 are carried by the flexible member 12 and thus moved relative to the interior surface I of the hollow tubing T as the flexible member 12 undergoes free movement through the tubing T in response to the pressure of the gas and the opening of the tubing T of the well as the surface of the earth. As the seal elements 27 move relative to the tubing T their exterior surfaces 27A are close to the interior surface I of the tubing T and thus wipe the interior surface I of the tubing T so as to prevent paraffin build-up on the interior surface I of the tubing T.

Figure 1:
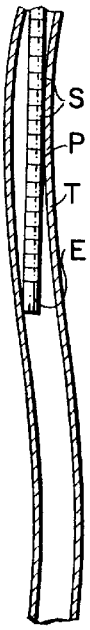
FIG. 1 (PRIOR ART)
FIG. 1 is a fragmentary side elevational view of a longitudinally-sectioned well tubing within which is employed a prior art rigid plunger.
Figure 2:
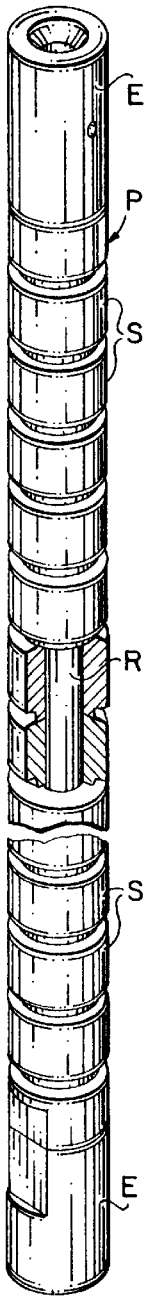
FIG. 2 (PRIOR ART)
FIG. 2 is an enlarged foreshortened partially sectioned perspective view of the prior art rigid plunger shown in FIG. 1.
Figure 4:
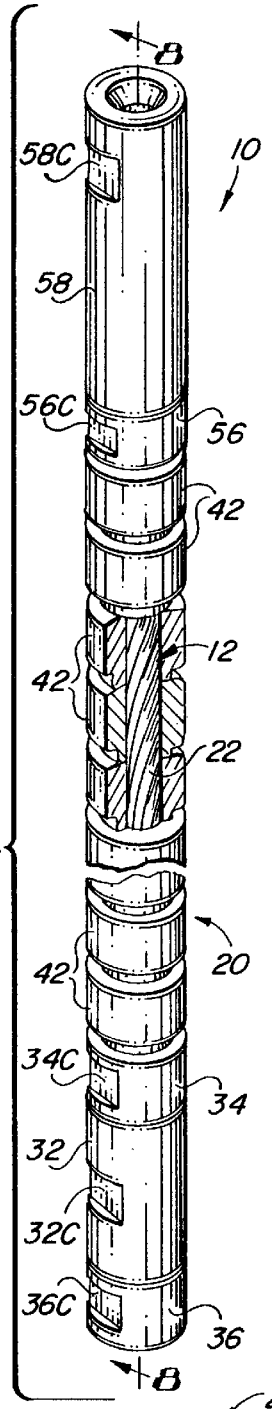
FIG. 4 is an enlarged foreshortened partially sectioned perspective view of a first embodiment of the flexible plunger apparatus of the present invention shown in FIG. 3.
Figure 5:
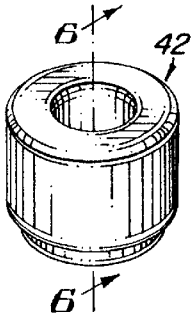
FIG. 5 (PRIOR ART)
FIG. 5 is an enlarged perspective view of an annular segment of one form of a prior art physical barrier producing means and tubing wall wiping means which can be employed by the first and second embodiments of the flexible plunger apparatus of the present invention shown in FIGS. 4 and 12.
Figure 11:
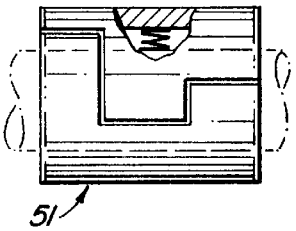
FIG. 11 (PRIOR ART)
FIG. 11 is an enlarged side elevational view of an expandable pad being still another form of a prior art physical barrier producing means and tubing wall wiping means which can be employed by the first and second embodiments of the flexible plunger apparatus of the present invention shown in FIGS. 4 and 12.
Figure 6:
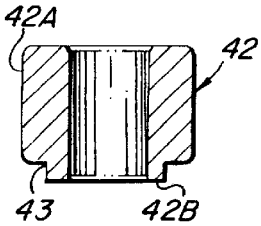
FIG. 6 (PRIOR ART)
FIG. 6 is an axial sectional view of the annular segment taken along line 6—6 of FIG. 5.
Figure 13:
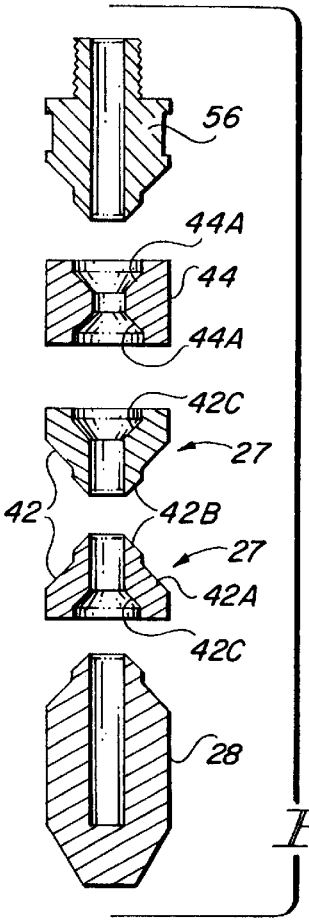
FIG. 13 is an exploded axial sectional view of parts of the physical barrier producing means of the apparatus of FIG. 12.

Referring now to the examples shown in FIGS. 5, 6 and 9–11, the seal elements 27 can take any of several different forms. The seal elements 27 can be a series of wobbly washer-like annular segments 42, as seen in FIGS. 5 and 6. The annular segments 42 are made substantially of a rigid material and are known per se having been employed heretofore and designated S on the prior art rigid plunger P of FIG. 2. Each annular segment 42 has a main annular body 42A and an annular outside recess 43 at one end which defines an annular central end flange 42B. The end flange 42B is a relatively smaller portion and has a relatively smaller diameter than that of the main body 42A of the annular segment 42. As shown in FIGS. 4, 7 and 8, the annular segments 42 can be arranged along the flexible member 12 with their end flanges 42B projecting in the same direction. Alternatively, as shown in FIGS. 12 and 13, each of the annular segments 42 can also have an opposite central recess 42C. The annular segments 42 can be arranged along the flexible member 12 in upper and lower groups separated by a middle spacer 44 having a pair of reversely tapered opposing recesses 44A formed in the opposite ends thereof. The end flanges 42B of the annular segments 42 of the upper group are pointed downwardly, while the end flanges 42B of the annular segments 42 of the lower group are pointed upwardly. The central end flange 42B of each annular segment 42 can nest in the central recess 42C of the adjacent annular segment 42.

Figure 9:
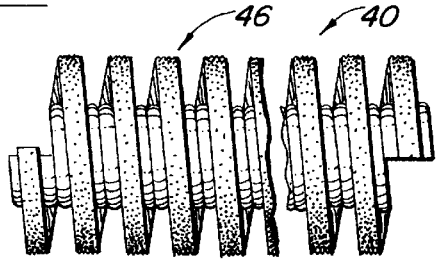
FIG. 9 (PRIOR ART)
FIG. 9 is an enlarged foreshortened side elevational view of a flexible brush segment being another form of a prior art physical barrier producing means and tubing wall wiping means which can be employed by the first and second embodiments of the flexible plunger apparatus of the present invention shown in FIGS. 4 and 12.
Figure 10:
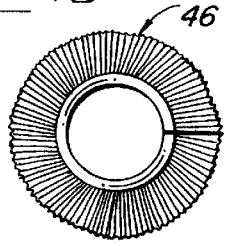
FIG. 10 (PRIOR ART)
FIG. 10 is an end view of the flexible brush segment shown in FIG. 9.

The seal element 27 alternatively can be a flexible brush segment 46, as shown in FIGS. 9 and 10. The flexible brush segment 46 has a rigid helical base 48 which will fit over the flexible member 12 and bristles 50 mounted on and projecting outwardly from the base 48. The brush segment 46 is known per se having been employed heretofore on the prior art rigid plunger P. The seal element 27 can also have other suitable designs and constructions known and used in the art such as the expandable pad 51 shown in FIG. 11.

Referring to FIGS. 7 and 8, the first embodiment of the apparatus 10 further includes a spring-loaded assembly 52 attached to one of the opposite end portions 14, 16 of the flexible member 12 and adapted to retain the particular seal elements 27 along the longitudinal length 18 of the flexible member 12 while accommodating flexing of the flexible member 12. For example, where the seal element 27 is a plurality of the annular segments 42 installed on the flexible member 12 filling the space between the opposite retainer elements 26, the spring-loaded assembly 52 is adapted to retain the annular segments 42 on the longitudinal length 18 of the flexible member 12 in a relatively close fitting side-by-side relation when the flexible member 12 is in a relatively straight unflexed state but to allow the annular segments 42 to move axially away from one another in response to flexing of the flexible member 12. The spring-loaded assembly 52 is also adapted to retain the flexible brush segment 46 on the longitudinal length 18 of the flexible member 12 in a relatively straight unflexed state when the flexible member 12 is likewise in a relatively straight unflexed state but to allow the flexible brush segment 46 to also flex and to move away from the spring-loaded assembly 52 in response to flexing of the flexible member 12. More particularly, the spring-loaded assembly 52 includes a compressible biasing element in the form of a coil spring 54 extending around and along the flexible member 12 and an inner cap 56 axially movably mounted on the flexible member 12 and having a threaded end 56A.

The apparatus 10 further includes a hollow fishneck element 58 that slidably fits over and covers the coil spring 54 and the one opposite end portion 14 of the flexible member 12. The fishneck element 58 is threadably coupled to the threaded end 56A of the inner cap 56 and thereby can axially move with the inner cap 56 relative to the flexible member 12 so as to permit the seal elements 27 to move axially in response to flexing of the flexible member 12. The fishneck element 58 also surrounds the annular ferrule 30 attached to the one opposite end portion 14 in the second embodiment of FIG. 12 and the annular ferrule 30, inner and outer threaded fittings 34, 36 and hollow threaded sleeve 34 in the first embodiment of FIGS. 7 and 8. It will be noted that the threaded sleeve 32 and inner and outer fittings 34, 36 at the upper end portion 14 of the flexible member 12 are smaller in their outside diameters than the corresponding components at the lower end portion 16 of the flexible member 12 which are of the same diameter as the outer fishneck member 58 and inner screw cap 56.

Figure 14:
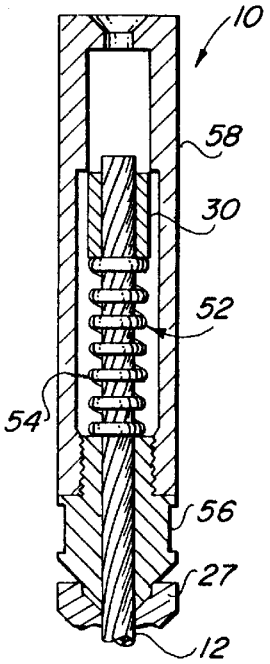
FIG. 14 is a fragmentary axial sectional view of the apparatus of FIG. 12 having one form of a fishneck element mounted thereon.

Referring to FIGS. 7, 8 and 14, the outer fishneck member 58 has an internally threaded inner end portion 58A and a cavity 60 with an internal shoulder 62 formed therein at an outer end portion 58B thereof. The internal shoulder 62 is provided within the cavity 60 for catching a hook for retrieving the apparatus 10 from the well tubing T. The outer fishneck member 58 further has a pair of opposite flat surfaces 58C on the external surface of the outer end portion 58B thereof while the inner screw cap 56 has an externally threaded portion 56A and a gripping portion 56B at opposite ends thereof. The gripping portion 56B of the inner screw cap 56 has a pair of external opposite flat surfaces 56C thereon. The opposite flat surfaces 58C, 56C on the respective outer fishneck member 58 and inner screw cap 56 facilitate gripping thereof by wrenches so as to permit rotation of the outer fishneck member 58 relative to the inner screw cap 56 and thereby threadably securing of the threaded portion 56A of the inner screw cap 56 into the inner end 58A of the outer fishneck member 58. The outer end portion 58B of the outer fishneck member 58 defining the cavity 60 with the internal shoulder 62 formed therein is known per se having been employed heretofore on the prior art rigid plunger P.

The spring-loaded assembly 52 functions by the coil spring 54 engaging the retainer element 26 and causing it to move toward an outer end 58B of the outer fishneck member 58 and away from the inner cap 56 such that the longitudinal length 18 of the portion of the flexible member 12 which extends between the inner cap 56 and the respective retainer element 26 is shortened and extra space between the annular seal elements 27 is removed thereby placing the annular seal elements 27 in end-to-end contact with one another when the flexible member 12 is in a relatively straight configuration. When the curvature of the tubing T of the well forces the flexible member 12 to flex transversely to its length, the coil spring 54 is forceably compressed by movement of the annular seal members 27 slightly axially away from one another along the flexible member 12 due to the bending or flexing of the flexible member 12. Such compression of the coil spring 54 allows the space along the flexible member 12 between the spring-loaded assembly 52 and one of the opposite retainer elements 26 to grow in length enough to provide sufficient space between the annular seal elements 27 to facilitate and permit such flexing of the flexible member 12.

Figure 15:
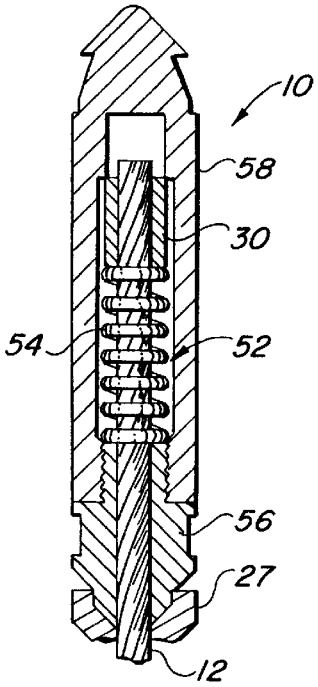
FIG. 15 is a fragmentary axial sectional view of the apparatus of FIG. 12 having another form of the fishneck element mounted thereon.

As mentioned above, the one retainer element 26 located adjacent to the coil spring 54 of the springloaded assembly 52 has a diameter substantially smaller than that of the opposite retainer element 26 so that the outer fishneck member 58 and the inner screw cap 56 fit thereover and cooperate with the one retainer element 26. If the outer fishneck member 58 were not necessary, then each of the opposite retainer elements 26 would have the same diameter. FIGS. 14 and 15 depict two different configurations for the fishneck member 58.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A flexible plunger apparatus for free movement in a gas-producing well below the earth surface, said apparatus comprising:

(a) an elongated flexible member having a pair of opposite upper and lower end portions and a longitudinal length extending between said opposite end portions, said flexible member being adapted to flex in transverse relationship to said length and to undergo free movement through an elongated hollow tubing of a well; and (b) means disposed about said flexible member and along said length and between said opposite end portions thereof for producing a physical barrier substantially separating gas under pressure in the tubing below said lower end portion of said flexible member from a slug of liquid in the tubing above said upper end portion of said flexible member as said physical barrier producing means is carried by said flexible member along the interior surface of the tubing upon free movement of said flexible member through the tubing of the well in response to the pressure of the gas and opening of the tubing of the well at the earth surface:

(c) said physical barrier producing means including a pair of retainer elements attached about said opposite end portions of said flexible member and at least one seal element disposed about said flexible member and extending between said retainer elements;

(d) each of said retainer elements including (i) an annular ferrule deformed so as to stationarily and fixedly grip a respective one of said opposite end portions of said flexible member, (ii) a hollow threaded sleeve, and (iii) a pair of inner and outer threaded fittings, said sleeve and fittings being applied and tightened together on a respective one of said opposite end portions of said flexible member so as to capture and clamp said annular ferrule thereon, (iv) said inner threaded fitting being threaded into a first threaded end of said hollow threaded sleeve thereby compressing and causing said annular ferrule to clamp around and grip said respective one of said opposite end portions of said flexible member at a location spaced from an outer end thereof, (v) said outer threaded fitting being threaded into a second threaded end of said hollow threaded sleeve and having a pointed end forced into said outer end of said respective one of said upper and lower end portions of said flexible member so as to cause said outer end to expand within said hollow threaded sleeve and thereby cause said annular ferrule to clamp around said respective one of said opposite end portions of said flexible member.

2. The apparatus of claim 1 wherein said flexible member is a substantially straight flexible cable.

3. The apparatus of claim 2 wherein said cable is multi-stranded and spirally-wound.

4. The apparatus of claim 1 wherein each of said annular ferrules is deformed on said flexible member by being crimped thereon.

5. The apparatus of claim 1 wherein said seal element of said physical barrier producing means has an exterior surface disposed adjacent to the interior surface of the tubing so as to wipe the interior surface of the tubing of the well as said flexible member undergoes free movement through the tubing so as to prevent paraffin build-up on the interior surface of the tubing.

6. A flexible plunger apparatus for free movement in a gas-producing well below the earth surface, said apparatus comprising:

(a) an elongated flexible member having a pair of opposite upper and lower end portions and a longitudinal length extending between said opposite end portions, said flexible member being adapted to flex in transverse relationship to said length and to undergo free movement through an elongated hollow tubing of a well;

(b) means disposed about said flexible member and along said length and between said opposite end portions thereof for producing a physical barrier substantially separating gas under pressure in the tubing below said lower end portion of said flexible member from a slug of liquid in the tubing above said upper end portion of said flexible member as said physical barrier producing means is carried by said flexible member along the interior surface of the tubing upon free movement of said flexible member through the tubing of the well in response to the pressure of the gas and opening of the tubing of the well at the earth surface, said physical barrier producing means including (i) a pair of retainer elements attached about said opposite end portions of said flexible member, and (ii) a plurality of seal elements mounted over and disposed along said flexible member and extending between said retainer elements attached on said opposite end portions thereof; and (c) a spring-loaded assembly attached to one of said opposite end portions of said flexible member and being adapted to expand and retain said seal elements on the flexible member along said length thereof in a relatively close fitting side-by-side relationship when said flexible member is in an unflexed state, said spring-loaded assembly being adapted to contract and allow said seal elements to move axially away from one another in response to flexing of said flexible member.

7. The apparatus of claim 6 wherein said flexible member is a substantially straight flexible cable.

8. The apparatus of claim 6 wherein each of said retainer elements includes an annular ferrule deformed so as to stationarily and fixedly grip a respective one of said opposite end portions of said flexible member.

9. The apparatus of claim 8 wherein said seal elements are arranged along said flexible member in upper and lower groups separated by a middle spacer, each of said seal elements in said upper group being oriented in one direction and each of said seal elements in said lower group being oriented in an opposite direction.

10. The apparatus of claim 6 wherein said seal elements have exterior surfaces disposed adjacent to the interior surface of the tubing so as to wipe the interior surface of the tubing of the well as said flexible member undergoes free movement through the tubing so as to prevent paraffin build-up on the interior surface of the tubing.

11. The apparatus of claim 6 wherein said spring-loaded assembly includes:

a biasing spring extending around and along said flexible member adjacent to and inwardly from one of said retainer elements; and an inner cap axially movably mounted on said flexible member adjacent to said seal elements.

12. The apparatus of claim 11 further comprising:

(d) a hollow fishneck element slidably fitted over and covering said biasing spring and said one opposite end portion of said flexible member, said fishneck element extending to and being coupled to said inner cap and thereby axially movable therewith relative to said flexible member so as to permit said seal elements to move axially in response to flexing of said flexible member.

* * * * *